United States Patent [19]

Mitrofanov et al.

[11] 4,289,280

[45] Sep. 15, 1981

[54] CRUSHER BOWL CLAMPING DEVICE

[76] Inventors: Evgeny S. Mitrofanov, ulitsa Kibalchicha, 4, korpus 1, kv. 17; Boris G. Ivanov, ulitsa Basseinaya, 5, kv. 8; Nikolai A. Ivanov, Novoizmailovsky prospekt, 19, kv. 96, all of Leningrad; Gennady A. Kaljunov, ulitsa Festivalnaya, 23, kv. 4; Isaak Y. Khinich, ulitsa Kosmonavtov, 43-b, kv. 71, both of Sverdlovsk, all of U.S.S.R.

[21] Appl. No.: 75,336

[22] Filed: Sep. 13, 1979

[51] Int. Cl.[3] ..... B02C 2/04

[52] U.S. Cl. ..... 241/207; 241/286

[58] Field of Search ..... 241/207-216, 241/286, 290

[56] References Cited

U.S. PATENT DOCUMENTS

| | | | |
|---|---|---|---|
| 2,590,795 | 3/1952 | Rumpel | 241/216 X |
| 3,140,834 | 7/1964 | Symons | 241/216 |
| 3,140,835 | 7/1964 | Balmer et al. | 241/286 |
| 3,405,875 | 10/1968 | Curtis | 241/207 |
| 3,539,118 | 11/1970 | Kueneman et al. | 241/286 X |
| 3,759,453 | 9/1973 | Johnson | 241/207 |
| 3,797,760 | 3/1974 | Davis et al. | 241/290 X |

*Primary Examiner*—Howard N. Goldberg

*Attorney, Agent, or Firm*—Lackenbach, Lilling & Siegel

[57] ABSTRACT

The crusher bowl clamping device comprises a stationary carrier ring screw-threaded to the bowl, a cylindrical bush mounted on the top end of the carrier ring, and a flange arranged above the bush carrying hydraulic jacks to provide a clamping thrust in the threads between the bowl and the carrier ring. The flange is matched and meshed by means of threads with the crushing bowl and is locked against rotation with respect to the carrier ring, and the hydraulic jack piston rods bear against the cylindrical bush.

2 Claims, 2 Drawing Figures

CRUSHER BOWL CLAMPING DEVICE

FIELD OF THE INVENTION

The present invention relates to intermediate and fine cone crushers, and more particularly to crusher bowl clamping devices.

The invention can most advantageously be used in the construction and ore-mining and dressing industries.

BACKGROUND OF THE INVENTION

The intermediate and fine cone crushers, which are now in use, comprise a crushing bowl and a breaking head accommodated therewithin to provide cavity, which cavity is terminated at its bottom portion with a discharge gap defined by the shortest distance between the crushing surfaces.

The breaking head is mounted on a spherical support secured to the crusher frame. The bowl is screw-threaded into a carrier ring mounted on the crusher frame. The breaking head drive is equipped with an eccentric or out-of-balance weight. Mounted on the crushing bowl and the breaking head are liners shaped as removable taper shells.

As a result of intensive wear of the liners, the discharge gap between their crushing surfaces becomes larger, resulting in coarser products being discharged from the crushing chamber. To stabilize the crushing process, the discharge gap is periodically adjusted, thus bringing it to the initial set value.

To adjust the discharge gap between the crushing bowl and the breaking head, the bowl is rotated in the threads and is then clamped with respect to the carrier ring. Clamping is accomplished with power means providing a thrust in said threads.

The bowl clamping device is one of the most critical units of the crusher because of high impact loads generated in the crushing cavity.

Known in the art is a device for clamping the bowl of intermediate and fine crushers (cf. USSR Inventor's Certificate No. 298,377). The device comprises a stationary carrier ring screw-threaded to the bowl, a cylindrical bush mounted on the top end of the carrier ring, a flange arranged above the bush, and wedge jacks are used to provide a clamping thrust in the threads between the bowl and the carrier ring.

In this device, the cylindrical bush is screw-threaded into the crushing bowl and rests upon the carrier ring through the wedge jacks which are placed in annular recesses of the bush and carrier ring.

The wedge jacks are fashioned as superimposed pairs of oppositely directed wedges. When the cylindrical bush is rotated to lock the bowl, the upper wedges, under the action of the force of friction, start slipping against the lower ones and shifting in the vertical plane, thereby providing a clamping thrust in the threaded joints of the bowl with the carrier ring and the bush. With the cylindrical bush rotated in the opposite direction, the upper wedges start slipping downward along the inclined surfaces of the lower wedges, which results in elimination of the upthrust in said threads.

However, the wedge jacks fail to provide a reliable clamp of the bowl in the threads since vibrations of the bowl and the carrier ring caused by crushing blows or impact loads in the crushing cavity eliminate the force of friction developed between the wedges, which sets the bowl free to rotate back out, followed by possible failure. Moreover, the wedge jacks are complex in manufacture.

Also known in the art is a crusher bowl clamping device (cf. U.S. Pat. No. 3,797,760). The device comprises a stationary carrier ring screw-threaded to the bowl, a cylindrical bush mounted on the top end of the carrier ring, and hydraulic jacks provide a clamping thrust to the threads between the bowl and the carrier ring. In this arrangement, as well as in the above analogue, the cylindrical bush is screw-threaded to the bowl. Arranged between the carrier ring and cylindrical bush at uniformly spaced points on the circumference are hydraulic jacks provided with spring-actuated rams. The hydraulic jacks have their cylinders seated in nests of the carrier ring, and the tips of their rams are seated in nests of the cylindrical bush. In the construction under consideration, the thrust in the threads to clamp the bowl results from the total action of a plurality of springs arranged under the rams of the hydraulic jacks. To permit the bowl to rotate, the thrust in the threads is eliminated by supplying oil under high pressure into the hydraulic cylinders. The rams therewith compress the spring stacks to thereby release the pressure of the piston rods upon the cylindrical bush. The rams are maintained in this position until the adjustment of the discharge gap between the bowl and the breaking head is completed. The oil pressure is then released and the springs of the hydraulic jacks again act through the piston rods upon the cylindrical bush that eliminates the clearance and provides a thrust in the threads between the bush and the bowl, as well as in the threads between the bowl and the carrier ring.

However, such design features low reliability. This is attributed to the fact that the hydraulic cylinders not only clamp the cylindrical bush but completely lock it, preventing it from slipping, whereas the bush tends, under the action of the force of friction, to rotate together with the bowl, while adjusting the discharge gap. This causes misalignment of the rams, damage of their sealings, scores on the walls of the hydraulic cylinders, and deformation of the piston rods. All these factors taken together generally make the device inoperative.

Moreover, the hydraulic cylinders are housed in a rotatable casing, making it impossible to watch their operation and deal quickly in time with any fault found.

Also known in the art is a crusher bowl clamping device (cf. USSR Inventor's Certificate No. 502,655). The device comprises a stationary carrier ring screw-threaded to the bowl, a cylindrical bush mounted on the top end of the carrier ring, and a flange arranged above the bush and carrying hydraulic jacks to provide a thrust in the threads between the bowl and the carrier ring.

In the device under consideration, the cylindrical bush is screw-threaded into an intermediate bush locked against rotation about the carrier ring and serves to support the flange. The cylindrical bush is also intended to rotate the bowl in the threads and is provided for torque transmission with a slot to receive a projection of the bowl. In projections arranged at uniformly spaced points on the circumference, there are secured piston rods of the hydraulic jacks mounted on the flange. Placed under the rams of the hydraulic jacks are stacks of springs serving to apply, via piston rods, a clamping upthrust in the threads between the bowl and the carrier ring. With the oil supplied under pressure into the hydraulic jacks, the spring stacks are compressed and the piston rods go downward, thereby eliminating the thrust in said threads. The bowl is then rotated with the aid of the cylindrical bush until the required discharge gap between the bowl and the breaking head is set. The flange carrying the hydraulic jacks is brought, through the piston rods, into rotation together with the bowl. The intermediate bush is shifting in a vertical direction together with and by the same value as the bowl and, therefore, retains its contact with the flange. Upon the adjustment of the discharge gap, the oil pressure is released and the spring stacks re-establish, through the piston rods, the upthrust in the threads between the bowl and carrier ring, thereby providing the clamp required.

This device is more reliable as compared with the above analogue, since it affords the rotation of the flange with a less frictional force to overcome, than it is in the threads.

However, in such a case, misalignment and jamming of the rams in the hydraulic jacks may occur.

Furthermore, the rotation of the hydraulic jacks together with the flange interferes substantially with the maintenance of the device under consideration. The rotation of the bowl is to be periodically interrupted to rearrange the oil-supplying hoses. This additional operation entails a prohibitive penalty of lost time.

Moreover, the device in question is complex in design.

SUMMARY OF THE INVENTION

It is an object of the present invention to increase the reliability of the crusher bowl clamping device.

Another object of the present invention is to simplify the operation of the crusher bowl clamping device.

A further object of the present invention is to cut down lost time when operating the crusher bowl clamping device.

Still another object of the present invention is to simplify the design of the crusher bowl clamping device.

With these and other objects of the present invention in view, there is provided a crusher bowl clamping device comprising a stationary carrier ring matched and meshed with the bowl, a cylindrical bush mounted on the top end of the carrier ring, and a flange arranged above the bush and carrying hydraulic jacks to provide thrust in the threads between the bowl and carrier ring, and wherein the flange is matched and meshed with the bowl and is locked to prevent its rotation with respect to the carrier ring, and the hydraulic jack piston rods bear against the cylindrical bush.

It is an advantage of the present invention that the power means of the hydraulic jacks are not subjected to the action of the deforming lateral loads during bowl rotation.

A further advantage of the present invention is that the flange carrying the hydraulic jacks remains stationary, while the device is in operation, thereby making unnecessary the periodical rearrangements of the oil-supplying hoses of the hyraulic jacks.

Such a design eliminates slipping and damaging of the piston rods when the bowl and the cylindrical bush are brought into rotation, since, in this case, the piston rods rest upon a stationary washer.

BRIEF DESCRIPTION OF DRAWINGS

The present invention will now be explained by detailed description of the preferred embodiments of the invention, and with reference to the accompanying drawings, wherein.

DETAILED DESCRIPTION OF THE INVENTION

Figure 1:
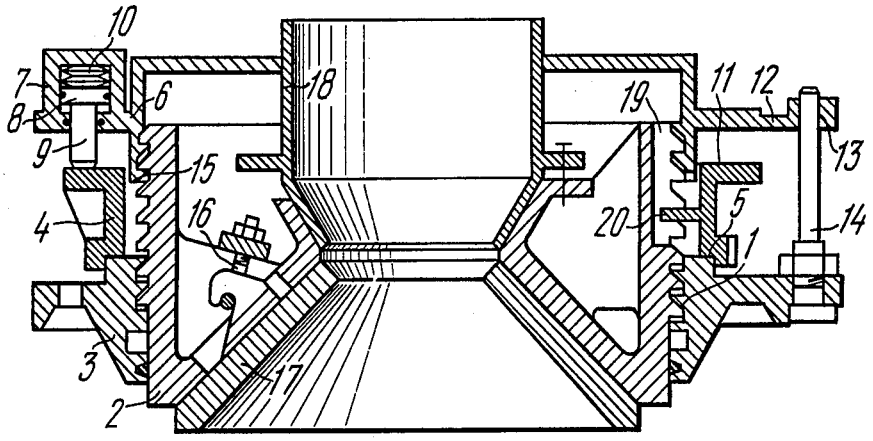
FIG. 1 is a longitudinal sectional view of a crusher bowl clamping device.

Referring to FIG. 1, the crusher bowl clamping device comprises a bowl 2 matched and meshed through threads 1 with a stationary carrier ring 3. Also a cylindrical bush 4 is mounted on the top end 5 of the carrier ring 3, and a flange 6 is arranged above the cylindrical bush 4 and carries hydraulic jacks 7 provided with rams 8 having piston rods 9 and stacks of disc springs 10. The piston rods 9 continuously bear and press against the top end 11 of the cylindrical bush 4. The flange 6 is provided with ears 12 having openings 13 to receive pins 14 which are rigidly secured to the carrier ring 3. The flange 6 is matched and meshed through threads 15 with the bowl 2, and clamps 16 secure a liner 17 and a feed chute 18. Provided in the bowl 2 is a vertical slot 19 to receive a projection 20 of the cylindrical bush 4.

Figure 2:
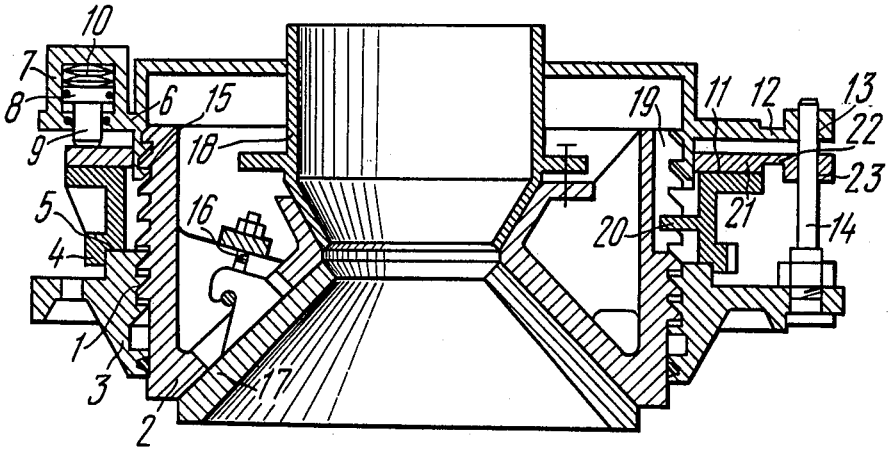
FIG. 2 is a view of one modification of the invention, wherein there is a washer between the push rods of the hydraulic jacks and the cylindrical bush.

Referring now to FIG. 2, there is shown a modification, wherein there is a washer 21 mounted between the piston rods 9 and the end 11 of the cylindrical bush 4, and said washer has ears 22, having openings 23 to receive the pins 14 which are used to lock the washer 21 as well as the flange 6 with respect to the carrier ring 3.

The crusher bowl clamping device of the present invention operates as follows.

Where a need arises to adjust the discharge opening between the crushing bowl and the breaking head, oil is supplied under pressure to the hydraulic jacks 7. By so doing, the rams 8 with the piston rods 9 are shifted upward to compress the stack of the springs 10 and release the thrust loading in the threads mating the flange 6 and carrier ring 3 with the crushing bowl 2. The rotation of the cylindrical bush 4 is imparted, with the aid of the projection 20, to the bowl 2 which is rotated until the required discharge gap is set. With the bowl 2 in rotation, the flange 6 and the washer 21 remain fixed with respect to the carrier ring 3. The oil pressure in the hydraulic jacks 7 is then released and the stacks of the springs 10 return the rams 8 with the piston rods 9 into their initial position. Upon being biased against the washer 21, the piston rods 9 cause the flange 6 and hence, through the washer 21, the bowl 2 to go upward. By so doing, clearance is eliminated and the clamping thrust is developed in the threads 1 and 15, which in turn ensures a reliable clamping of the bowl 2 with respect to the carrier ring 3.

The proposed crusher bowl clamping device makes it possible:

to increase the reliability of clamping the bowl;

to decrease the labor in the maintenance of the structure;

to cut down lost time when maintaining; and to simplify the design.

Although the present invention has been described in some detail by way of illustration and example for purposes of clarity of understanding, it will, of course, be understood that various changes and modifications may be made in the form, details, and arrangements of the parts without departing from the scope of the invention as set forth in the following claims.

We claim:

1. A crusher bowl clamping device comprising:

a stationary carrier ring threadably connected with a crushing bowl;

a cylindrical bush mounted on the top end of said carrier ring;

a flange arranged above said cylindrical bush and threadably connected to said crushing bowl, said flange carrying hydraulic jacks with piston rods to provide thrust in the threaded connection between said crushing bowl and said carrier ring;

said flange being locked against rotation about said carrier ring; and said piston rods of said hydraulic jacks being continuously biased against said carrier ring, so as to thrust load the threaded connection between said flange and said carrier ring with the crushing bowl.

2. A device in accordance with claim 1, further including a washer between said piston rods of said hydraulic jacks and said cylindrical bush and said washer is locked against rotation about said carrier ring.

* * * * *